United States Patent [19]

Nakajima et al.

[11] Patent Number: 4,922,429

[45] Date of Patent: May 1, 1990

[54] METHOD FOR CONTROLLING AN AIR/FUEL RATIO OF AN INTERNAL COMBUSTION ENGINE

[75] Inventors: Toyohei Nakajima; Yasushi Okada; Toshiyuki Mieno; Nobuyuki Oono, all of Wako, Japan

[73] Assignee: Honda Giken Kogyo Kabushiki Kaisha, Tokyo, Japan

[21] Appl. No.: 21,334

[22] Filed: Mar. 3, 1987

[30] Foreign Application Priority Data

Mar. 4, 1986 [JP] Japan ..... 61-047546

[51] Int. Cl.[5] ..... F02B 51/02; F02B 3/04

[52] U.S. Cl. ..... 364/431.06; 364/431.05; 123/489; 123/440; 123/480

[58] Field of Search ..... 364/431.05, 431.06; 123/440, 489, 480

[56] References Cited

U.S. PATENT DOCUMENTS 4,365,299 12/1982 Kondo et al. ..... 123/440 X 4,430,976 2/1984 Kondo et al. ..... 123/489 X 4,467,769 8/1984 Matsumura ..... 123/489

4,580,539 4/1986 Kitahara ..... 123/491 X 4,646,699 3/1987 Yasuoka et al. ..... 123/489

*Primary Examiner*—Parshotam S. Lall

*Assistant Examiner*—V. N. Trans

[57] ABSTRACT

A method for feedback controlling an air/fuel ratio of mixture supplied to an internal combustion engine to a target air/fuel ratio, which uses an output signal of an oxygen concentration sensor. The sensor's output signal is proportional to the oxygen concentration in the exhaust gas of the engine. When the target air/fuel ratio is set at a stoichiometric air/fuel ratio, the air/fuel ratio of the mixture is varied by a small amount around the stoichiometric value if the air/fuel ratio of mixture supplied to the engine is detected to be in a predetermined air/fuel ratio range which includes the stoichiometric air/fuel ratio. The determination of the air/fuel ratio is calculated from the output signal of the oxygen concentration sensor.

10 Claims, 7 Drawing Sheets

METHOD FOR CONTROLLING AN AIR/FUEL RATIO OF AN INTERNAL COMBUSTION ENGINE

BACKGROUND OF THE INVENTION

1. Field of the Invention

The present invention relates to a method for controlling an air/fuel ratio of an internal combustion engine, and more particularly to a method by which an air/fuel ratio of a mixture to be supplied to the engine is controlled using feedback towards a target value in response to an output signal level of an oxygen concentration sensor.

2. Description of Background Information

Conventional methods for controlling the air/fuel ratio by feedback operation utilize oxygen concentration in the exhaust gas of the engine which is detected by an oxygen concentration sensor and the air/fuel ratio of mixture being supplied to the engine to approach a target value in response to an output signal level from the $O_2$ sensor for the purpose of the purification of the exhaust gas and improvements of the fuel economy.

On the other hand, in engines equipped with a three-way catalytic converter in the exhaust system, it is conventional to control the air/fuel ratio of the mixture being supplied to the engine to a stoichiometric value (14.7) since, as shown in FIG. 1, an optimum operation of the three-way catalytic converter is attained when the air/fuel ratio of the supplied mixture is at around the stoichiometric air/fuel ratio. (Japanese Patent Application Laid open No. 59-201,946 and Japanese Patent Application Laid Open No. 60-19931 are examples of such a technique).

In the conventional technique of the air/fuel ratio control, a type of oxygen concentration sensor whose output signal level is not proportional to the oxygen concentration in the exhaust gas has been utilized. As shown in FIG. 2, the output signal characteristic of this type of oxygen concentration sensor is such that different two stable output levels appear on both sides of the stoichiometric air/fuel ratio, i.e., in the rich region and the lean region.

In the air/fuel ration control methods using the oxygen concentration sensor whose output signal level is not proportional to the oxygen concentration, it is possible to detect from the output signal level of the oxygen concentration sensor, whether the air/fuel ratio of the supplied mixture is on the rich side or on the lean side with respect to the stoichiometric air/fuel ratio. However, it is difficult to determine, from the output signal level of the oxygen concentration sensor, that the center of the air/fuel ratio of the supplied mixture is at the stoichiometric air/fuel ratio. Therefore, it is difficult to ascertain if the three-way catalytic converter is operating effectively when trying to attain a good exhaust gas purification operation.

It is also known that the purification rate of the three-way catalytic converter can be raised by a perturbation operation by which the air/fuel ratio is varied around the stoichiometric air/fuel ratio as a central value. Further, as shown in FIG. 3, the degree of the improvement of the purification rate is proportional to the frequency of the perturbation operation. In conventional methods of air/fuel ratio control, a perturbation effect is generated through the process of the feedback control. Therefore, the frequency of perturbation is determined by such factors as the moving time of the mixture and the exhaust gas, the delay in the response of the oxygen concentration sensor, and the operational time lag of the control system. More specifically, the frequency of the perturbation is increased as the period of each cycle of the feedback control reduces. In this cycle the air/fuel ratio of the mixture being supplied to the engine is adjusted on the air intake side; the oxygen concentration in the exhaust gas is detected by the oxygen concentration sensor; and the air/fuel ratio of the mixture being supplied to the engine is again controlled on the basis of the result of the detection of the oxygen concentration.

However, as shown in FIG. 4, the period of the feedback control varies in inverse proportion to the rotational speed of the engine, and as shown in FIG. 5, increases as the position of the oxygen concentration sensor in the exhaust gas passage is shifted on the downstream side. Therefore, even if the air/fuel ratio of the mixture is detected to be at the stoichiometric value accurately by the oxygen concentration sensor, it does not mean that the efficiency of the purification of the exhaust gas by the three-way catalytic converter meets the minimal requirements, since the frequency of the perturbation can not be raised to a high enough level.

OBJECT AND SUMMARY OF THE INVENTION

An objective of the present invention is to provide a method of air/fuel ratio control by which the efficiency of the exhaust gas purification operation of the three-way catalytic converter is improved.

According to the present invention, in a method for feedback controlling an air/fuel ratio of a mixture for an internal combustion engine to a target air/fuel engine, the engine having a three-way catalytic converter in an exhaust gas passage, and an oxygen concentration sensor which produces an output signal proportional to the oxygen concentration in exhaust gas of the engine and is disposed in the exhaust gas passage on upstream side of the three-way catalytic converter, the improvement comprises the steps of:

detecting, from the output signal of the oxygen concentration sensor, whether the air/fuel ratio of mixture supplied to the engine is in a predetermined air/fuel ratio range including a stoichiometric air/fuel ratio when the target air/fuel ratio is set at the stoichiometric air/fuel ratio; and varying the air/fuel ratio of mixture around the stoichiometric air/fuel ratio when it is detected by the detecting step that the air/fuel ratio of mixture supplied to the engine is in the predetermined air/fuel ratio range.

In short, a method for controlling an air/fuel ratio of an internal combustion engine which features the air/fuel ratio of the mixture being supplied to the engine causes the air/fuel ratio to vary around the stoichiometric air/fuel ratio as a central value by a small amount when it is detected from an output signal of an oxygen concentration sensor of a type producing an output signal proportional to the oxygen concentration that the air/fuel ratio of the mixture supplied to the engine is in a predetermined range which includes the stoichiometric air/fuel ratio.

According to another aspect of the present invention, the varying step comprises a step for determining first and second correction coefficient values corresponding to an air/fuel ratio value above the stoichiometric air/fuel ratio and another air/fuel ratio value below the stoichiometric air/fuel ratio, respectively, and a step for correcting the air/fuel ratio of mixture by using the first and second correction coefficient values alternately.

According to a further aspect of the present invention, the internal combustion engine has a crankshaft wherein the varying step is performed at a frequency determined according to a rotational speed of the crankshaft.

DETAILED DESCRIPTION OF A PREFERRED EMBODIMENT

Referring to the accompanying drawings, an embodiment of the present invention will be explained below.

Figure 1:
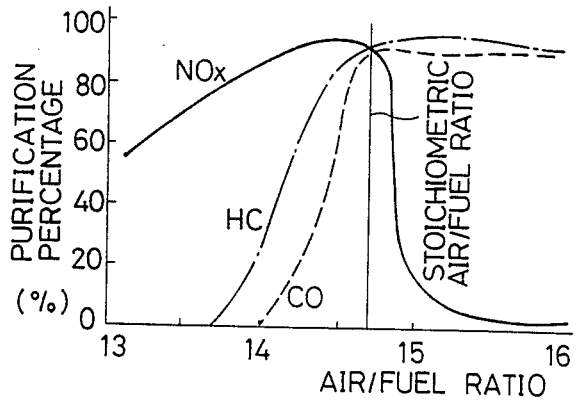
FIG. 1 is a graph showing curves illustrating the relation between the exhaust gas purification percentage and the air/fuel ratio in the case of a three-way catalytic converter.
Figure 2:
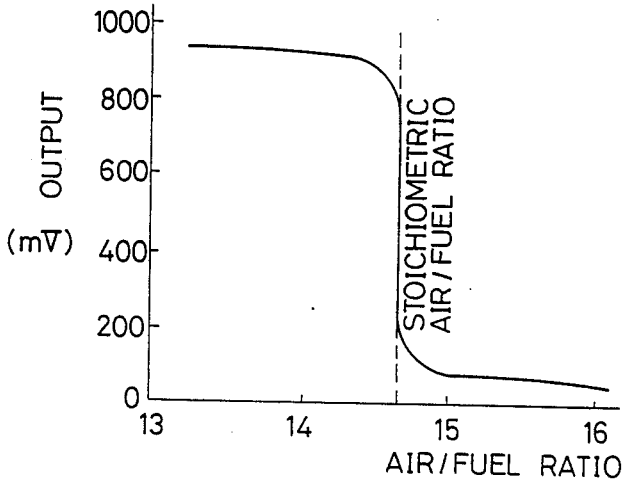
FIG. 2 is a graph showing an output signal characteristic of a type of oxygen concentration sensor whose output signal level is not proportional to the oxygen concentration in the exhaust gas.
Figure 3:
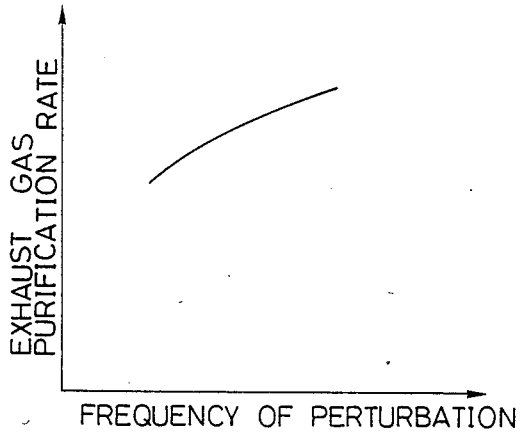
FIG. 3 is a graph showing a relation between the exhaust gas purification rate and the frequency of perturbation.
Figure 4:
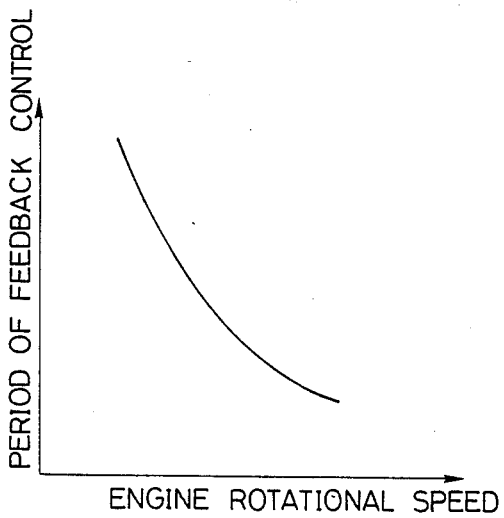
FIG. 4 is a graph showing a relation between the period of one feedback control cycle and the rotational speed of the engine.
Figure 5:
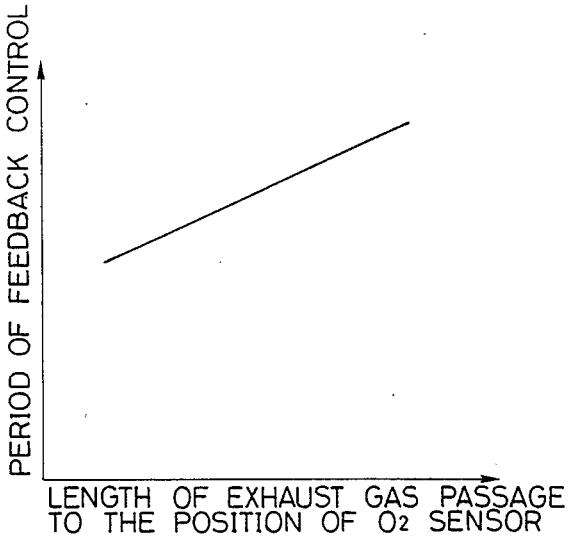
FIG. 5 is a graph showing a relation between the period of one feedback control cycle and the position of the oxygen concentration sensor in the exhaust gas passage.
Figure 6:
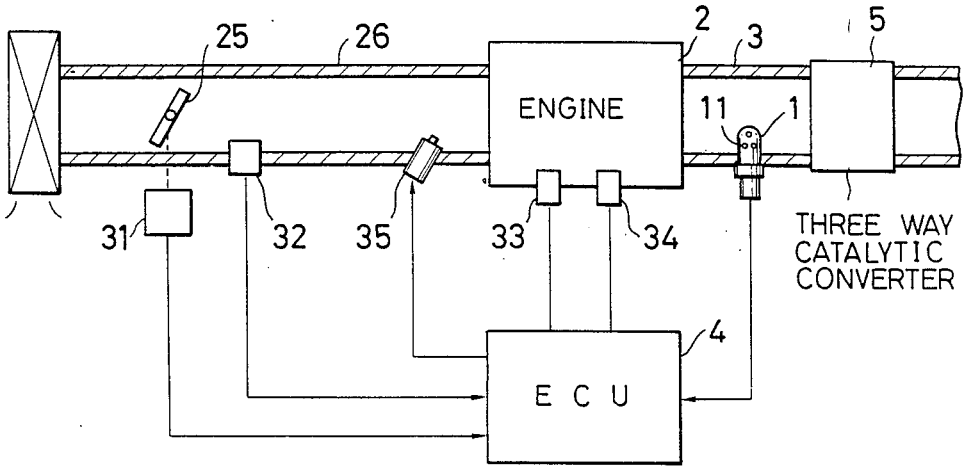
FIG. 6 is a schematic diagram showing a general construction of a fuel injection system in which the air/fuel ratio control method according to the invention is applied.
Figure 7:
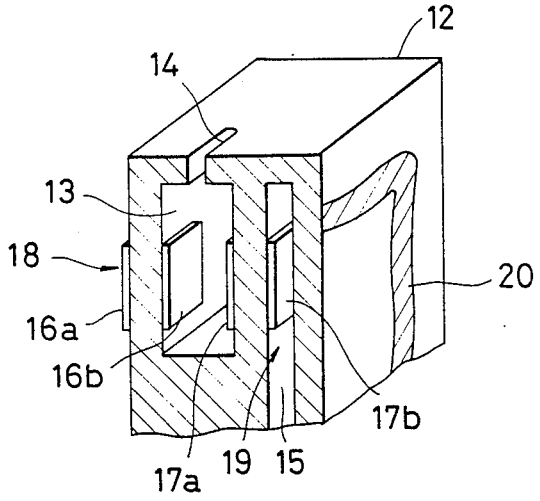
FIG. 7 is a diagram showing an inside of the detection part of the oxygen concentration sensor used in the system of FIG. 6.
Figure 8:
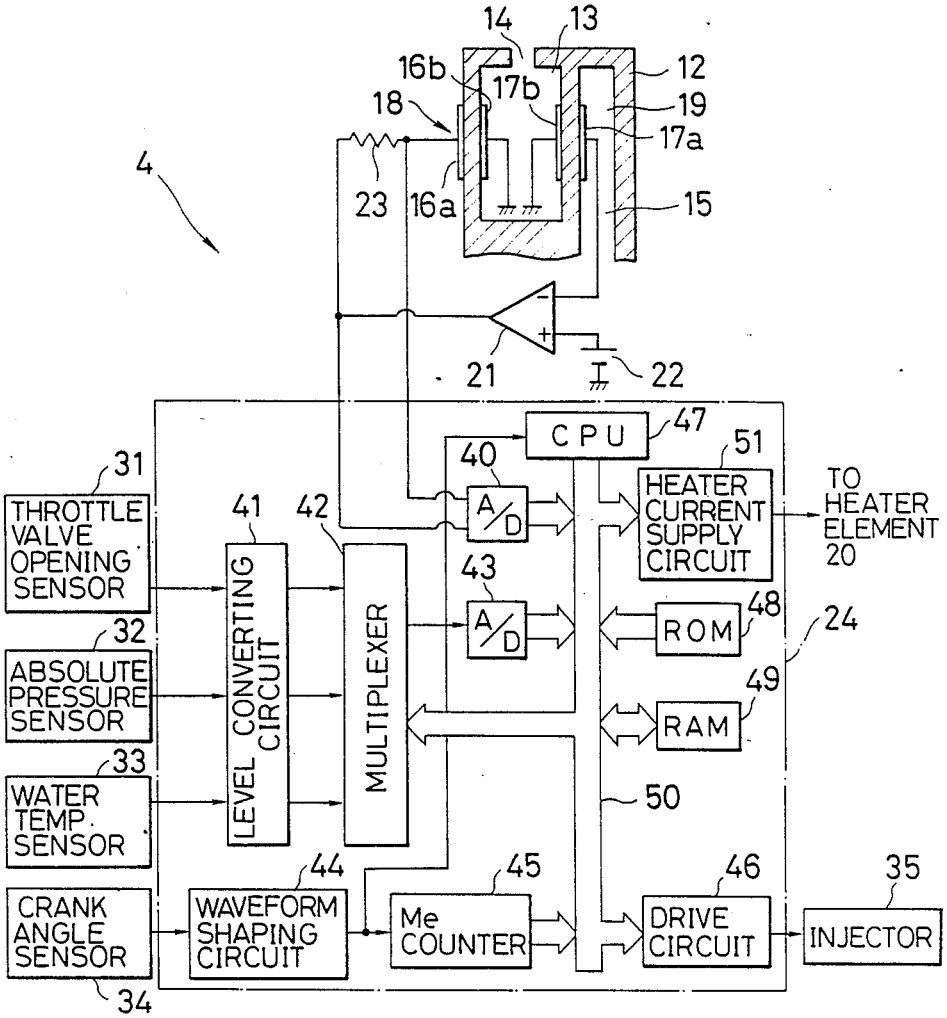
FIG. 8 is a block diagram showing the circuit construction of the ECU 4 of the system of FIG. 6.

FIGS. 6 through 8 illustrate an electronically controlled fuel injection system for an internal combustion engine in which the air/fuel ratio control method of the present invention is adopted. In this system, an oxygen concentration sensor of the oxygen concentration proportional type is utilized, and a detection part 1 of the oxygen concentration sensor is disposed in an exhaust gas passage 3, on the upstream side of a three-way catalytic converter 5. Input and output signals of the detection part 1 of the oxygen concentration sensor is connected to an ECU (electronic control unit) 4.

In a protection case 11 of the oxygen concentration sensor, there is provided an oxygen ion conductive solid electrolyte member 12 having a general configuration of rectangular parallel piped as shown in FIG. 7. In the oxygen ion conductive solid electrolyte member 12, a gas retaining chamber 13 is provided. The gas retaining chamber 13 leads to a gas introduction hole 14 for introducing the measuring gas, i.e., the exhaust gas of the engine, from outside of the oxygen ion conductive solid electrolyte member 12. The gas introduction hole 14 is positioned in the exhaust gas passage 3 so that the exhaust gas can easily flow into the gas retaining chamber 13. The oxygen-ion conductive solid electrolyte member 12 is provided with a reference atmospheric air chamber 15 into which atmospheric air is introduced, in such a manner that the reference atmospheric air chamber 15 is separated from the gas retaining chambers 13 by means of a partition wall between them. In the partition wall between the gas retaining chamber 13 and the reference atmospheric air chamber 15, and in the wall of the gas retaining chamber 13 on the opposide side of the atmospheric air chamber 15, there are respectively a pair of electrodes 17*a* and 17*b* and a pair of electrodes 16*a* and 16*b*. The solid electrolyte member 12 and the pair of electrodes 16*a* and 16*b* operate together as an oxygen pump element 18. On the other hand, the solid electrolyte member 12 and the pair of electrodes 17*a* and 17*b* operate together as a sensor cell element 19. Further, a heater element 20 is provided on an outer wall of the reference atmospheric air chamber 15. In the oxygen ion conductive solid electrolyte 12, zirconium dioxide ($ZrO_2$) is used, and platinium (Pt) is used as the electrodes 16*a* through 17*b*.

As shown in FIG. 8, the electronic control unit 4 includes a differential amplifier 21, a reference voltage source 22, a current detection resistor 23 and a control circuit 24. The electrode 16*b* of the oxygen pump element 18 and the electrode 17*b* of the sensor cell element 19 are grounded. The differential amplifier 21 is connected to the electrode 17*a* of the sensor cell element 19 to produce an output voltage corresponding to the difference between a voltage generated across the electrodes 17*a* and 17*b* of the sensor cell element 19 and a voltage generated by the reference voltage source 22. The output voltage of the reference voltage source 22 has a level (0.4 V for example) corresponding to the stoichiometric air/fuel ratio. The output terminal of the differential amplifier 21 is connected to the electrode 16*a* of the oxygen pump element 18 through the current detection resistor 23. Terminals of the current detection resistor 23 operate as output terminals of the oxygen concentration sensor, and are connected to the control circuit 24 which may be a microcomputer.

To the control circuit 24, there are connected a throttle opening sensor 31 which comprises a potentiometer and generates an output voltage whose level corresponds to the opening of a throttle valve 25; an absolute pressure sensor 32 provided in an intake pipe 26 on the downstream side of the throttle valve 25; which generate an output signal whose level corresponds to the absolute pressure in the intake pipe 26; a cooling water temperature sensor 33 for generating an output voltage whose level corresponds to the cooling water temperature of the engine; and a crank angle sensor 34 for generating a pulse train signal in synchronism with the rotation of the crankshaft (not shown) of the engine. Also, an injector 35 provided in an intake pipe 26 of the engine 2, near intake valves (not shown), is connected to the control circuit 24.

The control circuit 24 includes an A/D converter 40 having differential input which converts the voltage across the terminals of the current detection resistor 23 to a digital signal; a level converting circuit 41 for performing the level conversion of the output signals of the throttle opening sensor 31, the absolute pressure sensor 32, and the water temperature sensor 33; a multiplexer 42 for selectively outputting one of the output signals of the sensors through the level converting circuit 41; and A/D converter 43 for converting the signal supplied from the multiplexer 42 into a digital signal; a waveform shaping circuit 44 for performing the waveform shaping of the output signal of the crank angle sensor 34 and outputting it as a TDC signal; a counter 45 for detecting the period of the TDC signal by counting the number of clock pulses supplied from a clock pulse generating circuit (not shown); a drive circuit 46 for driving the injector 35; a a CPU (central processing unit) 47 for executing digital operations according to programs; a ROM 48 in which various operation programs and data are previously stored; and a RAM 49. The A/D converters 40 and 43, the multiplexer 42, the counter 45, the drive circuit 46, the CPU 47, the ROM 48, and the RAM 49 are mutually connected by means of an input-/output bus 50. Further, a heater current supply circuit 51 is provided in the control circuit 24. A heater current is supplied from the heater current supply circuit 51 to the heater element 20 in accordance with a command from the CPU 47 to heat the heater element 20.

Data indicative of a pump currents $I_P$ flowing through the oxygen pump element 18 from the A/D converter 40, the throttle opening $\theta$th, the absolute pressure $P_{BA}$ in the intake pipe, the cooling water temperature $T_W$ selectively from the A/D converter 43, and the engine rotational speed Ne from the counter 45 are supplied to the CPU 47 through the input/output bus 50. The CPU 47 executes an air/fuel ratio control routine in accordance with a clock pulse signal in the manner described later. The CPU 47 reads the various above-mentioned data in accordance with the program stored in the ROM 48 and calculates a fuel injection time $T_{OUT}$ for the injector 35 corresponding to the amount of the fuel to be supplied to the engine 2 using a calculation formula described later from this data and in synchronism with the TDC signal in a fuel supply routine. The fuel injector 35 is actuated by the drive circuit 46 only for the fuel injection time $T_{OUT}$ so as to supply the fuel to the engine 2.

The fuel injection time $T_{OUT}$ is, for example, calculated by the following formula:

$$T_{OUT}=T_i\times K_{O2}\times K_{WOT}\times K_{TW} \quad (1)$$

where $T_i$ represents a basic supply amount determined by the engine rotational speed Ne and the pressure $P_{BA}$ in the intake passage; $K_{O2}$ represents a feedback correction coefficient of the air/fuel ratio which is determined in accordance with the output signal level of the oxygen concentration sensor; $K_{WOT}$ represents a fuel increment correction coefficient for a high load operation, and $K_{TW}$ represents a coefficient of the engine coolant temperature. The correction coefficients of $K_{O2}$, $K_{WOT}$, and $K_{TW}$ are set in subroutines of the fuel supply routine.

On the other hand, when the supply of the pump current to the oxygen pump element 18 is started, a voltage developing across the electrodes 17a and 17b of the sensor cell element 19 becomes lower than the voltage of the output signal of the reference voltage source 22 if the air/fuel ratio of the mixture supplied to the engine 2 is in the lean region. Therefore, the differential amplifier 21 produces a positive output signal. This positive output signal is supplied to the series circuit of the resistor 23 and the oxygen pump element 18. Since the pump current flows from the electrode 16a to the electrode 16b of the oxygen pump element 18, oxygen in the gas retaining chamber 13 is ionized at the electrode 16b. This oxygen moves through the inside of the oxygen pump element 18 and is released in the form of oxygen gas at the electrode 16a. The oxygen in the gas retaining chamber 13 is pumped out in this way.

By pumping the oxygen in the gas retaining chamber 13, a difference of oxygen concentration develops between the exhaust gas in the gas retaining chamber 13 and the atmospheric air in the reference atmospheric air chamber 15. A voltage Vs corresponding to this difference of oxygen concentration develops across the electrodes 17a and 17b, and which voltage Vs is supplied to the inverting input terminal of the differential amplifier 21. Since the output voltage of the differential amplifier 21 has a voltage proportional to the difference between the voltage Vs and the voltage of the output signal of the reference voltage source 22, the pump current value becomes proportional to the oxygen concentration in the exhaust gas, and the pump current value is outputted as a voltage across the terminals of the resistor 23.

Figure 9:
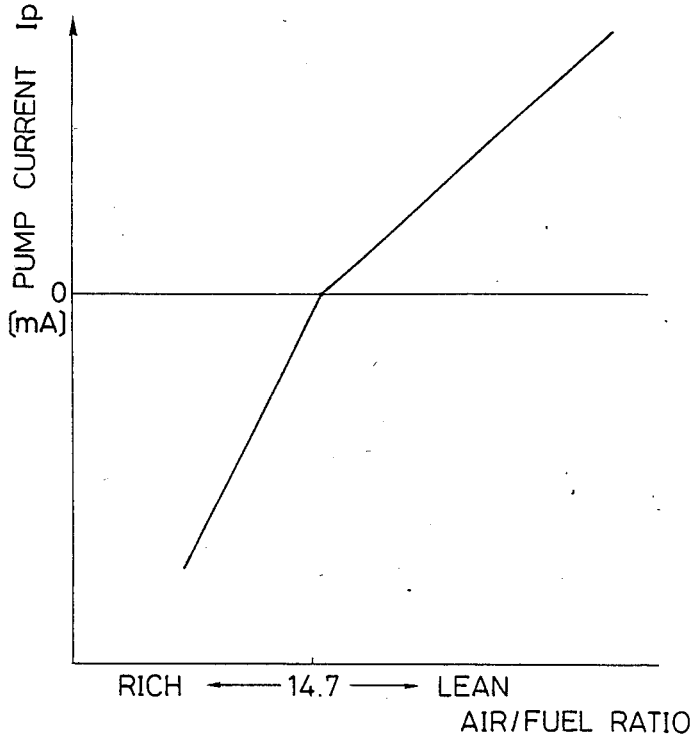
FIG. 9 is an output signal characteristic of the oxygen concentration proportional type oxygen concentration sensor used in the system of FIG. 6.

The voltage Vs exceeds the output voltage of the reference voltage source when the air/fuel ratio of the mixture is in the rich region. Therefore, the output signal level of the differential amplifier 21 changes from the positive level to the negative level. This negative level output signal causes the pump current flowing across the electrodes 16a and 16b of the oxygen pump element 18 to decrease, thereby causing a change in the direction of the current. Under this condition, the pump current flows from the electrode 16b to the electrode 16a. The oxygen in the outside is ionized at the electrode 16a and moves through the inside of the oxygen pump element 18 to the electrode 16b where the oxygen ion is released into the gas retaining chamber 13 in the form of oxygen gas. Therefore, by supplying the pump current so that the oxygen concentration in the gas retaining chamber 13 is always maintained constant, oxygen is pumped into the gas retaining chamber 13 or pumped out from the gas retaining chamber 13. Therefore, as shown in FIG. 9, the pump current value $I_P$ and the output voltage of the differential amplifier 21 become proportional to the oxygen concentration in the exhaust gas, i.e. the air/fuel ratio in both of the lean and rich regions. In accordance with this pump current, the above mentioned feedback correction coefficient $K_{O2}$ is determined.

Figure 10:
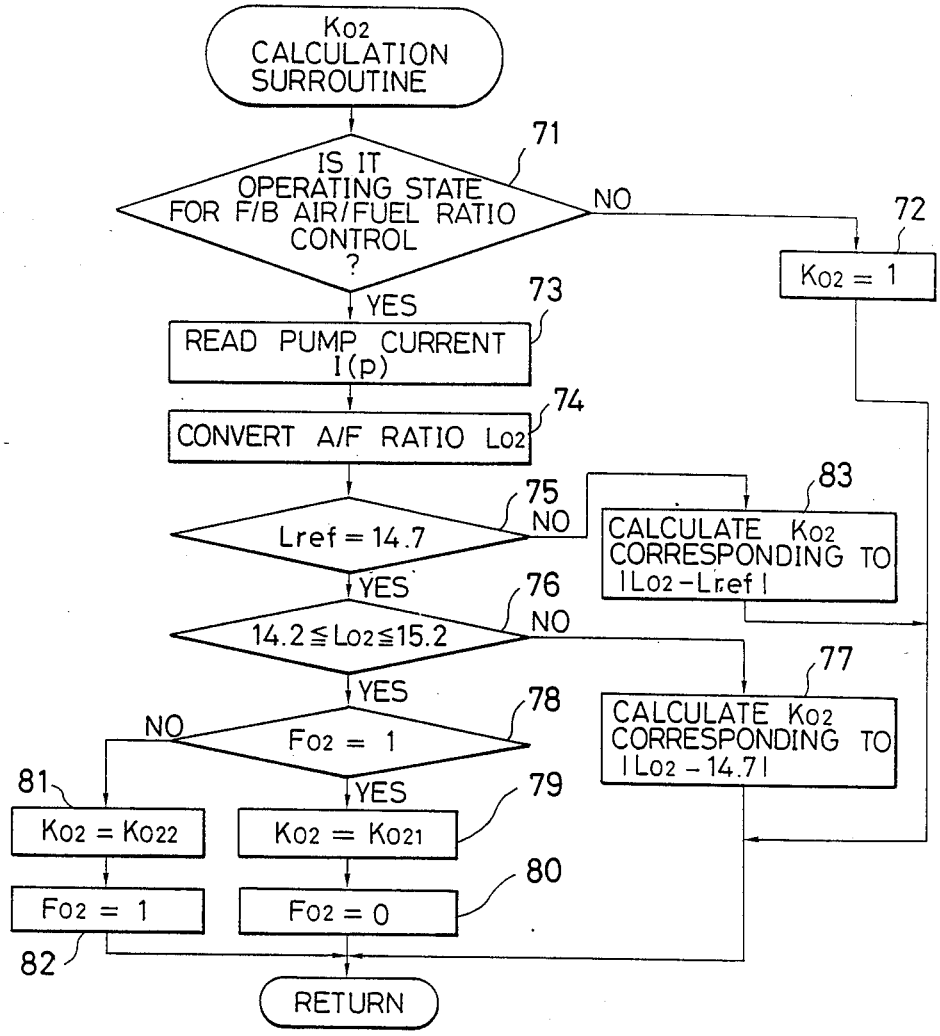
FIG. 10 is an operational flowchart showing the manner of operation of the CPU 47 of the system of FIG. 6.

The steps of the air/fuel ration control method according to the present invention will be explained with reference to the operational flowchart of the CPU 47 which is illustrated in FIG. 10 as the $K_{O2}$ calculation subroutine.

In this calculation procedure, at step 71 the CPU 47 first determines whether or not the operating state of the engine is a state in which the air/fuel ratio feedback control is to be performed. This determination is performed by using the parameters of the opening $\theta$th of the throttle valve, the cooling water temperature $T_W$ of the engine, and the absolute pressure $P_{BA}$ of the intake pipe. For example, if an accelerating state or a decelerating state is determined to be the state in which the feedback control of the air/fuel ratio is to be stopped, the correction coefficient $KO_2$ is made equal to 1 at step 72. On the other hand, if it is determined that the feedback control of air/fuel ratio should be performed, the pump current value $I_P$ is read at step 73. The pump current value $I_P$ read at the step 73 is converted to an air/fuel ratio $L_{O2}$ corresponding to the read value of the pump current $I_P$, at a step 74. It is then determined whether or not a target air/fuel ratio Lref is set at the stoichiometric air/fuel ratio (14.7) at step 75. The target air/fuel ratio Lref is established at a target air/fuel ratio setting subroutine in accordance with the engine's operational conditions. If the taget air/fuel ratio Lref is set at the stoichiometric air/fuel ratio, it is determined whether or not the air/fuel ratio $L_{O2}$ is in a range of 14.7±0.5 at step 76. If $L_{O2}<14.2$ or if $L_{O2}>15.2$, the feedback correction coefficient is calculated on the basis of the air/fuel ratio $L_{O2}$ at step 77. In other words, the correction coefficient $K_{O2}$ corresponding to the difference $|L_{O2}-14.7|$ is calculated. On the other hand, if $14.2 \leqq L_{O2} \leqq 15.2$, it is determined whether or not a flag $F_{O2}$ is equal to 1 at step 78. If $F_{O2}=1$, the correction coefficient $K_{O2}$ is made equal to a predetermined value $K_{O21}$ at step 79, and the flag $F_{O2}$ is made equal to 0 at a step 80. If $F_{O2}=0$, the correction coefficient $K_{O2}$ is made equal to a predetermined value $K_{O22}$ at step 81, and the flag $F_{O2}$ is made equal to 1 at step 82.

If it is detected that the target air/fuel ratio Lref is set at a value other than the stoichiometric air/fuel ratio at step 75, the feedback correction coefficient $K_{O2}$ is calculated on the basis of the difference $|L_{O2}-Lref|$ at step 83.

In the above-explained air/fuel ratio controlling method according to the present invention, the $K_{O2}$ calculation subroutine is executed in synchronism with the cycle of the generation of the TDC signal. The content of the flag $F_{O2}$ changes each time there is the generation of the TDC signal if the air/fuel ratio $L_{O2}$ detected from the pump current value $I_P$ of the oxygen concentration sensor continuously falls in the range of 14.7±0.5. Thus, the two predetermined values $K_{O21}$ and $K_{O22}$ are alternately used as the correction coefficient $K_{O2}$. The predetermined value $K_{O21}$ is a value obtained by adding a predetermined value $\Delta K_{O2}$ to the correction value $K_{O2}$ for controlling the air/fuel ratio to the value of 14.7, and the predetermined value $K_{O22}$ is a value obtained by subtracting the predetermined value $\Delta K_{O2}$ from the correction coefficient $K_{O2}$ for controlling the air/fuel ratio to the value of 14.7. The fuel injection time $T_{OUT}$ is calculated according to the formula (1) using this correction coefficient $K_{O2}$, and the fuel is supplied to the engine 2 by means of the injector 35 only during the fuel injection time $T_{OUT}$. Therefore, the air/fuel ratio of the mixture to be supplied to the engine 2 swings to the rich side or to the lean side with respect to the value of 14.7 as a central value, in accordance with the TDC signal. The perturbation of the air/fuel ratio control is performed in this way.

In the above described embodiment of the present invention, the frequency of perturbation is proportional to the frequency of the generation of the pulses in the TDC signal. However, it is to be noted that the above example is not limitative, and for example, the frequency of the perturbation can be determined to be proportional to the frequency of the generation of the pulses in a clock pulse train.

Further, in the above described embodiment of the present invention, the air/fuel ratio of the mixture is controlled by adjusting the fuel supply amount in accordance with the pump current value $I_P$. However, besides the above embodiment, it is also possible to apply the method according to the present invention to an air/fuel ratio control system of air intake side secondary air supply type, by adjusting the amount of the air intake side secondary air in accordance with the pump current value $I_P$.

In view of the foregoing, it will be appreciated if, according to the present invention, it is possible to accurately detect that the air/fuel ratio of the mixture supplied to the engine is in a predetermined range having the stoichiometric value, by using an oxygen concentration sensor of a type generating an output signal proportional to the oxygen concentration. When the air/fuel ratio of the mixture is in the predetermined range having the stoichiometric value, the air/fuel ratio of the mixture is forcibly varied by a small amount with respect to the stoichiometric value as the central value. Therefore, the frequency of the perturbation can be raised even if the period of each cycle of the feedback control becomes long because of the position of the oxygen concentration sensor in the exhaust system. Therefore, the efficiency of exhaust gas purification by the three-way catalytic converter can be improved.

What is claimed is:

1. In a method for feedback controlling an air/fuel ratio of a mixture supplied to an internal combustion engine to a target air/fuel ratio, the engine having a three-way catalytic converter in an exhaust gas passage, and an oxygen concentration sensor which produces an output signal substantially proportional to the oxygen concentration in exhaust gas of the engine and which is disposed in the exhaust gas passage upstream from the three-way catalytic converter, the supplied air/fuel ratio of the mixture being feedback controlled towards the target air/fuel ratio in accordance with the output of the oxygen concentration sensor, comprising the steps of:

(a) detecting the air/fuel ratio of the mixture in accordance with the output of the oxygen concentration sensor;

(b) determining if the target air/fuel ratio is equal to a stoichiometric air/fuel ratio;

(c) detecting if the detected air/fuel ratio is within a predetermined air/fuel ratio range when the target air/fuel ratio is equal to the stoichiometric air/fuel ratio, the predetermined air/fuel ratio range including the stoichiometric air/fuel ratio; and (d) compulsorily varying the air/fuel ratio around the stoichiometric air/fuel ratio at predetermined intervals so long as it is detected in said detecting step (c) that the detected air/fuel ratio falls within the predetermined air/fuel ratio range.

2. The method as claimed in claim 1, wherein said varying step (d) comprises the steps of:

(e) determining first and second correction coefficient values corresponding to an air/fuel ratio value above the stoichiometric air/fuel ratio and another air/fuel ratio value below the stoichiometric air/fuel ratio, respectively; and (f) correcting the air/fuel ratio of mixture by using the first and second correction coefficient values alternately.

3. The method as claimed in claim 1, wherein said varying step (d) is performed at a frequency determined according to a rotational speed of the internal combustion engine.

4. A method for controlling an air/fuel ratio in an internal combustion engine, comprising the steps of:

(a) positioning a three-way catalytic converter in an exhaust gas passage of the engine;

(b) selecting an oxygen concentration sensor which produces an output signal proportional to the oxygen concentration in exhaust gas of the engine;

(c) positioning the oxygen concentration sensor in the exhaust gas passage upstream from the catalytic converter;

(d) selecting a target air/fuel ratio that is equal to a stoichiometric air/fuel ratio;

(e) determining if an actual air/fuel ratio is within a predetermined air/fuel ratio range, the predetermined air/fuel ratio including the target air/fuel ratio;

(f) varying the actual air/fuel ratio around the target air/fuel ratio; and (g) repeating said step (f) so long as the actual air/fuel ratio determined in said step (e) is within the predetermined air/fuel ratio range.

5. The method as claimed in claim 4, wherein said step (f) includes the steps of:

(h) determining a first correction value corresponding to an air/fuel ratio value which is above the target air/fuel ratio;

(i) determining a second correction value corresponding to an air/fuel ratio which is below the target air/fuel ratio; and (j) correcting the actual air/fuel ratio by using the first and second correction values alternatively.

6. The method as claimed in claim 4, wherein said step (g) is performed at a frequency corresponding to a rotational speed of the engine.

7. A method for controlling an air/fuel ratio in an internal combustion engine, the engine having a three-way catalytic converter in an exhaust gas passage and an oxygen concentration sensor, the oxygen concentration outputting a signal proportional to the oxygen concentration in an exhaust gas and being positioned in the exhaust gas passage upstream from the catalytic converter, comprising the steps of:

(a) selecting a target air/fuel ratio;

(b) determining if the target air/fuel ratio is equal to a stoichiometric air/fuel ratio;

(c) determining if an actual air/fuel ratio is within a predetermined air/fuel ratio range when step (b) determines that the target air/fuel ratio is equal to the stoichiometric air/fuel ratio, the predetermined air/fuel ratio range including the stoichiometric air/fuel ratio;

(d) varying the actual air/fuel ratio around the stoichiometric air/fuel ratio when step (c) determines that the actual air/fuel ratio is within the predetermined air/fuel ratio; and (e) repeating said step (d) so long as the actual air/fuel ratio determined in said step (c) is within the predetermined air/fuel ratio range.

8. The method as claimed in claim 7, wherein said varying step (d) varies the air/fuel ratio in a rich ratio direction and in a lean ratio direction alternatively.

9. The method as claimed in claim 7, wherein said step (d) includes the steps of:

(h) determining a first correction value corresponding to an air/fuel ratio value which is above the target air/fuel ratio;

(i) determining a second correction value corresponding to an air/fuel ratio which is below the target air/fuel ratio; and (j) correcting the actual air/fuel ratio by using the first and second correction values alternatively.

10. The method as claimed in claim 7, wherein said step (g) is performed at a frequency corresponding to a rotational speed of the engine.

* * * * *